US007316269B1

(12) United States Patent
Moretz

(10) Patent No.: US 7,316,269 B1
(45) Date of Patent: Jan. 8, 2008

(54) ENCLOSED RADIAL WIRE-LINE CABLE CONVEYING METHOD AND APPARATUS

(76) Inventor: Benny W. Moretz, P.O. Box 1389, Manvel, TX (US) 77578

( * ) Notice: Subject to any disclaimer, the term of this patent is extended or adjusted under 35 U.S.C. 154(b) by 188 days.

(21) Appl. No.: 11/157,544

(22) Filed: Jun. 21, 2005

Related U.S. Application Data

(63) Continuation-in-part of application No. 10/396,054, filed on Mar. 24, 2003, now Pat. No. 7,051,803.

(51) Int. Cl.
*E21B 19/084* (2006.01)

(52) U.S. Cl. ..... 166/77.1; 166/385

(58) Field of Classification Search ..... 166/77.1, 166/385, 384, 84.1, 77.2, 77.3, 84.4, 241.5, 166/241.6
See application file for complete search history.

(56) References Cited

U.S. PATENT DOCUMENTS 3,496,998 A * 2/1970 Weaver ..... 166/351
3,762,725 A 10/1973 Taylor
4,091,867 A * 5/1978 Shannon et al. ..... 166/77.3
4,577,693 A 3/1986 Graser
4,684,155 A * 8/1987 Davis ..... 285/16
5,156,420 A * 10/1992 Bokor et al. ..... 285/21.2
5,188,174 A * 2/1993 Anderson, Jr. ..... 166/77.3
5,392,861 A 2/1995 Champagne
5,662,312 A 9/1997 Leggett et al.
6,006,839 A * 12/1999 Dearing et al. ..... 166/384
6,247,534 B1 6/2001 Newman
6,530,432 B2 * 3/2003 Gipson ..... 166/384

* cited by examiner

*Primary Examiner*—David Bagnell
*Assistant Examiner*—Daniel P Stephenson
(74) *Attorney, Agent, or Firm*—Robert N. Montgomery

(57) ABSTRACT

A relatively light weight radial wire-line conveyance mechanism capable of sustained high pressure incorporated into a wire-line riser set-up and configured to allow multiple radial bends without sheaves. The conveyance mechanism includes a segmented tubular body structure capable of being pressurized and defining a radial arc of between 0 and 180 degree having a threaded coupling at each end for connection to riser tubular joints. The tubular body contains a series of connected tubular segments, each of which includes a longitudinal bore and a roller or ball assembly therein defining a pressurized wire-line pathway for receiving wire-line that passes through each of the tubular segments.

14 Claims, 14 Drawing Sheets

ENCLOSED RADIAL WIRE-LINE CABLE CONVEYING METHOD AND APPARATUS

This is a continuation-in-part of my previously filed application filed Mar. 24, 2003 Ser. No. 10/396,054, now U.S. Pat. No. 7,051,803.

FIELD OF THE INVENTION

This invention relates generally to wire-line equipment used in conducting down-hole well operations including well completion activities, well servicing activities, and the installation and removal of various down-hole well tools. More particularly, the present invention concerns an enclosed radial wire-line cable conveyance mechanism through which a wire-line passes as the wire-line is being run into or extracted from a well bore and wherein the conveyance mechanism is capable of containing well pressures in the range of 10,000 psi or greater and to provide for continuous grease injected sealing of the wire-line while in a number of configurations.

BACKGROUND OF THE INVENTION

It is frequently necessary during drilling or completion operations to conduct well bore logging activities. Such activities involve the use of a logging tool run into the well to evaluate the progress of the well's bore and to identify various characteristics of the earth formation adjacent the well bore. Logging operations are typically carried out by running various logging tools into the well using a variety of wire-line cables. Various other well servicing activities are often conducted using down-hole tools that are run into well bores or well casing using wire-line apparatus. When wells are being logged or completed on live wells, high-pressure conditions are often encountered. When such high pressures are encountered, wire-line pipe risers of significant height are often employed within the well derrick or above the well head in order to provide the wire-line pipe risers with sufficient length to house the down-hole tool and a sufficient length of weight bar to overcome the well pressure and thus pull the tool and its logging wire-line cable into the well bore. These wire-line risers incorporate grease wipers and/or wire-line packers in addition to various valves necessary to render the wire-line apparatus safe for containing the well's pressure.

Typically an open upper sheave is mounted above the wire-line riser and the wire-line cable being run into or exiting the well extends above the riser and passes around the upper sheave and thence downwardly to a lower sheave, near the drill floor level, in route to a wire-line cable winch, typically mounted on a wire-line service vehicle located adjacent the derrick. More recently, rather than providing extremely tall wire-line risers, especially where the height of the wire-line riser may be restricted, it has become customary to provide a pressure containing upper sheave. The upper sheave may be located at the upper end of a wire-line riser and incorporated therein to provide a grease seal conduit extending downwardly from the upper pressure-containing sheave head, thus providing a wire-line riser containing apparatus of sufficient length for efficient pressure containing capability but with approximately half the overall height. An example of a pressure-containing sheave disposed in pressure connection with a wire-line riser and a grease seal conduit is presented by U.S. Pat. No. 5,188,173 of Richardson, et al, and U.S. Pat. No. 5,662,312 of Leggett, et al. These types of pressure-containing sheaves have deficiencies in that they are restricted relative to their weight and pressure containing capability due to the significant area of the housings. The housings are also subject to considerable pressure induced side loading that, especially under high-pressure conditions, can significantly distort the body structure to the extent that the sheaves can become inoperative. It is therefore desirable to provide a light weight, radial pressurized wire-line cable conveyance mechanism having high pressure capability for wire-line well servicing apparatus and other completion activities utilizing wire-line services that are also configurable to produce multiple radial bends that reduce or eliminate the need for open or closed sheaves all together.

SUMMARY OF THE INVENTION

The instant invention is a relatively lightweight radial wire-line conveyance mechanism capable of sustained high pressure, which may be incorporated into a wire-line riser configuration and configured to allow multiple radial bends thus eliminating the need for sheaves. The features of this invention are realized through the provision of a tubular body structure capable of being pressurized defining a radius between 0 and 180 degrees including a threaded connection at each end or by any other suitable means for connection to down-hole tubular joints. The tubular body structure defines an internal bore within which is located a series of connected tubular blocks each of which includes a longitudinal bore and roller therein defining a wire-line pathway for receiving a wire-line that passes through each of said tubular blocks located throughout the body structure. The rollers in each of the tubular blocks are directly lubricated by grease that is continuously pumped into the internal bore.

It therefore is an object of the radial wire-line conveyance mechanism or carrier to reduce the overall height of the wire-line lubricator string resulting from crane height limitations.

Another object of the invention is to reduce pollution by reducing the height of the external sheave and grease head associated with wire-line operations.

Yet another object of the invention is to eliminate wire-line cable from jumping external sheaves.

Another object of the invention is to reduce length of lubrication hoses associated with wire-line injection operations and thus increase visibility of the wire-line insertion operation by reducing the illuminated area required.

Still another object of the invention is to prevent spinning and twisting of the wire-line by the wire-line sheave.

Yet another object of the invention is to simplify pick-up and lay-down of lubricator and eliminating external top sheaves in some cases.

Another object of the invention is to provide an enclosed, pressurized, radial, light weight wire-line conveyor that reduces bearing loading, especially with large diameter wire-line cable.

Still another object of the invention is to provide a means for radially conveying a wire-line in multiple planes thereby permitting pivotal "Chickson" type lubricator section set up for wire-line operations.

These and other objects may be better seen and described by the drawings and detailed descriptions to follow.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
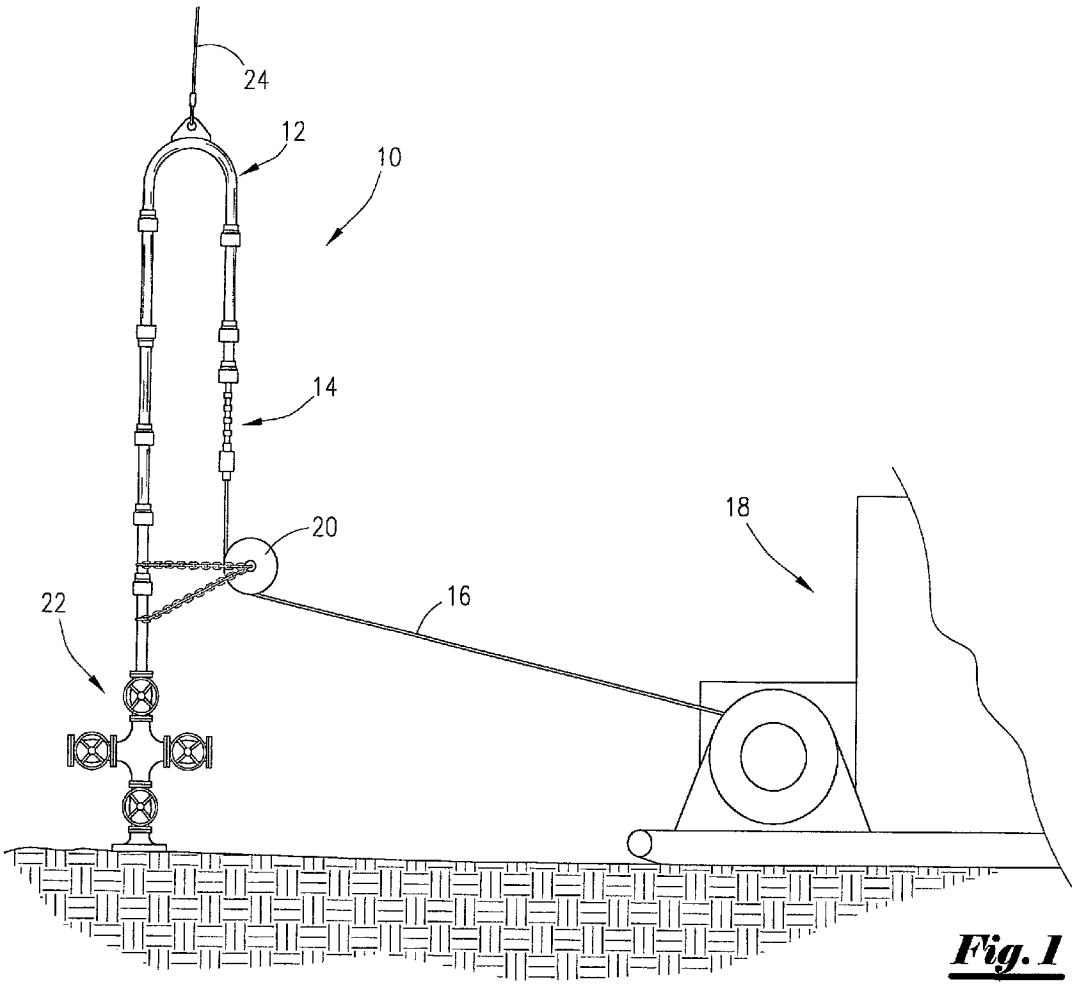
FIG. 1 is vertical elevation view of the preferred embodiment of the radial wire-line cable conveyer adapted to a wire-line riser attached to a wellhead and supported by crane.

The wire-line cable riser rig-up assembly 10 illustrated in FIG. 1 would seem to be impractical due to the friction and wear factors associated with simply bending a pipe or tube as seen at the top of the riser in a 180-degree arch. However, as disclosed herein, utilizing a 180-degree wire-line cable conveyer located within the tubular member to form a high pressure, wire-line cable conveyor assembly 12, allows the grease head assembly 14 to be located closer to ground level. The arrangement further eliminates the need for a large, heavy diameter sheave and the problems associated therewith when this arrangement is currently attempted. The wire-line 16 can still be fed to the grease head assembly 14 from the reel assembly 18 utilizing the lower temporary sheave 20. The riser assembly 10 in this embodiment is illustrated as being attached to a wellhead assembly 22 and supported by a crane wire-line cable 24.

Figure 2:
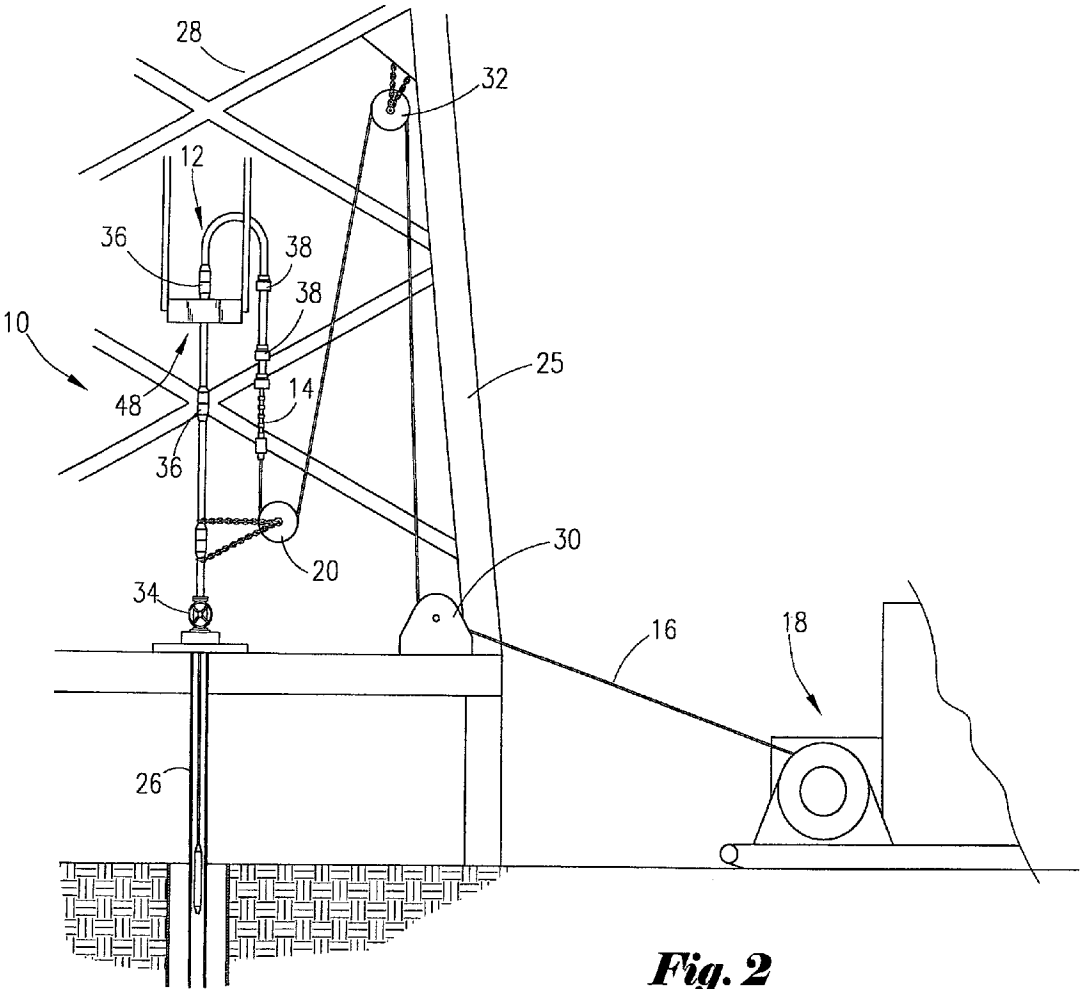
FIG. 2 is vertical elevation view of the preferred embodiment of the radial wire-line cable conveyer adapted to wire-line riser with free-point rig-up in a derrick.

As illustrated in FIG. 2, the 180-degree wire-line cable conveyor assembly 12 and riser assembly 10 may be utilized with a derrick 25 in a free-point rig-up arrangement whereby the riser assembly 10 and multiple joint sections of pipe located within the well bore 26 may be lifted by the rig wire-line cable line 28 by utilizing a free-point riser set-up as shown here. In this case the wire-line cable 16 is passed though a deck sheave 30 to an intermediate derrick supported sheave 32 before being passed to the lower temporary sheave 20 leading vertically to the grease head 14. In this arrangement a temporary shut-in valve 34 is used to close off wellhead pressure leading to the riser assembly 10. It should also be noted that due to excessive weight on the joints, lifting requires threaded pipe joints 36 rather than Bowen™ (registered mark of Bowen Tool, Inc.)—type quick couplings generally used for making up wire-line riser assemblies. However, when using the bent wire-line cable conveyer assembly 12 as illustrated in FIG. 2, joints located between the conveyer assembly 12 and the lower sheave 20 can still use the Bowen™ quick fittings.

Figure 3:
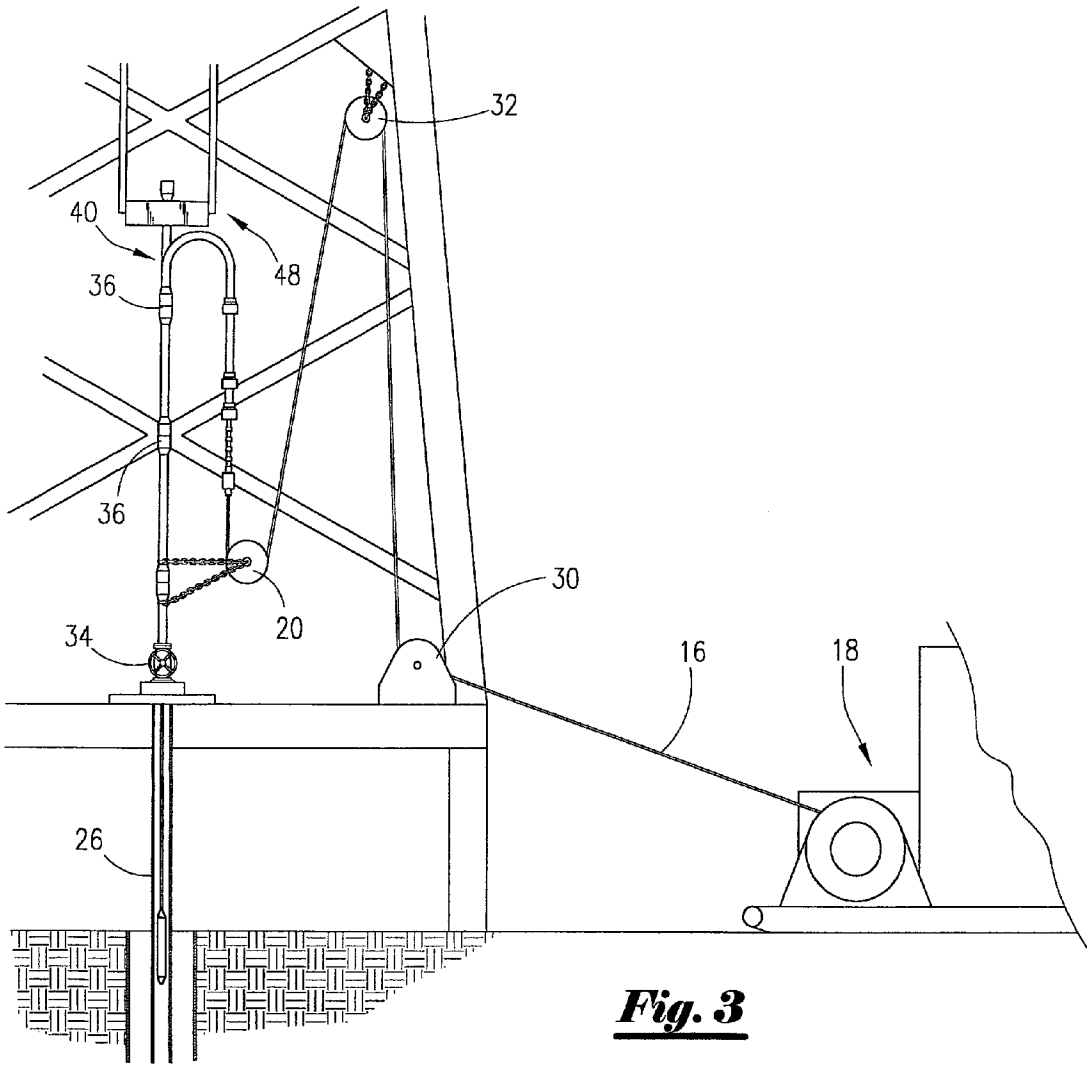
FIG. 3 is a vertical elevation view of a second embodiment of the radial wire-line cable conveyer and wire-line riser with free-point rig-up in a derrick adapted for use with top drive.
Figure 4:
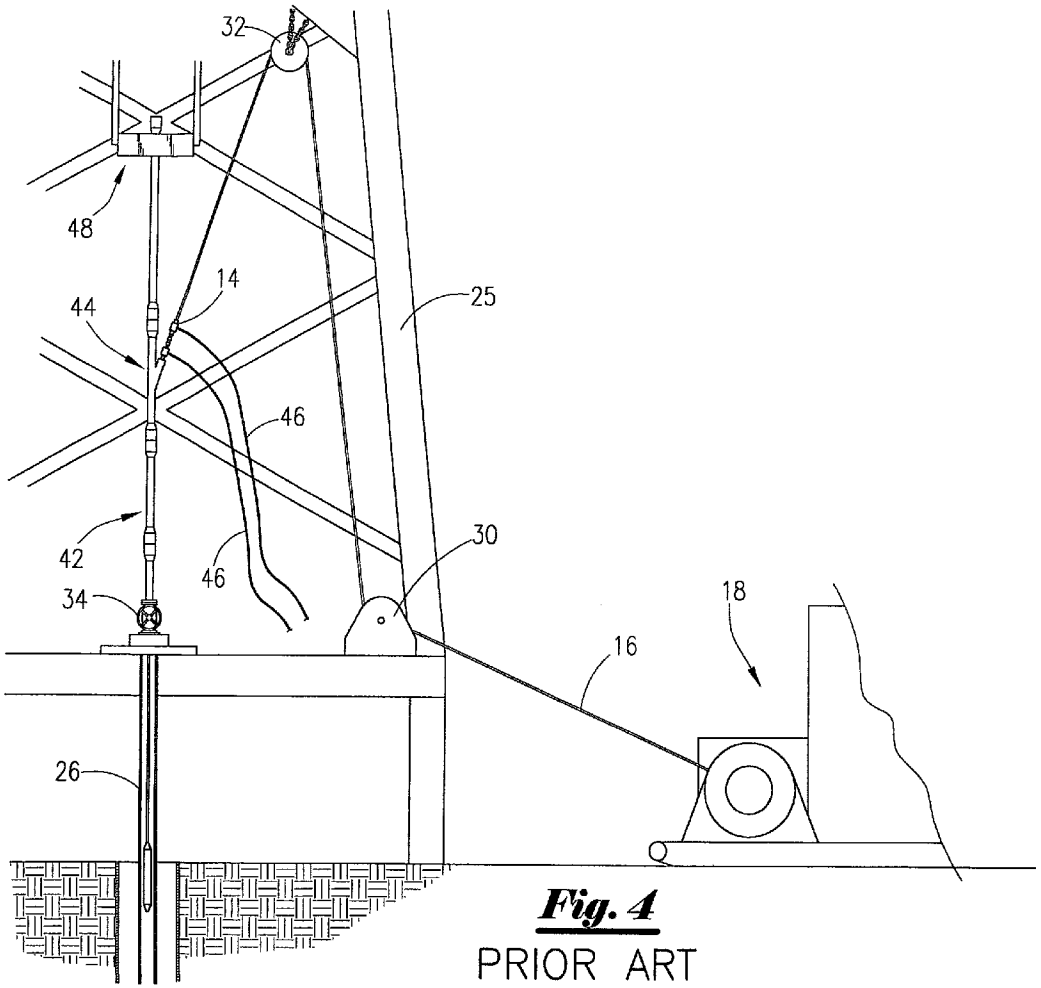
Fig. 4 PRIOR ART
FIG. 4 is a vertical elevation view of the prior art free-point rig-up.

Looking now at FIG. 3 we see that the same set-up and riser assembly seen in FIG. 2 may be used with a top drive derrick. However, in this case, the bent 180 degree wire-line cable conveyer assembly 12 in the previous figures has now been modified for top drive connection and lifting apparatus by forming an "h" configuration designated here as item 40 and referred to as the top drive 180 degree wire-line cable conveyor. This configuration is by far easier to control than the "Y" arrangement in current practice as illustrated in FIG. 4. In this configuration the riser assembly 42 is by necessity quite lengthy, thus placing the "Y" sub 44 and the grease head 14 very high in the derrick 25, requiring very long grease lines 46. The arrangement also utilizes the elevators 48 for lifting the pipe string and riser assembly 42 from the well bore 26.

Figure 5:
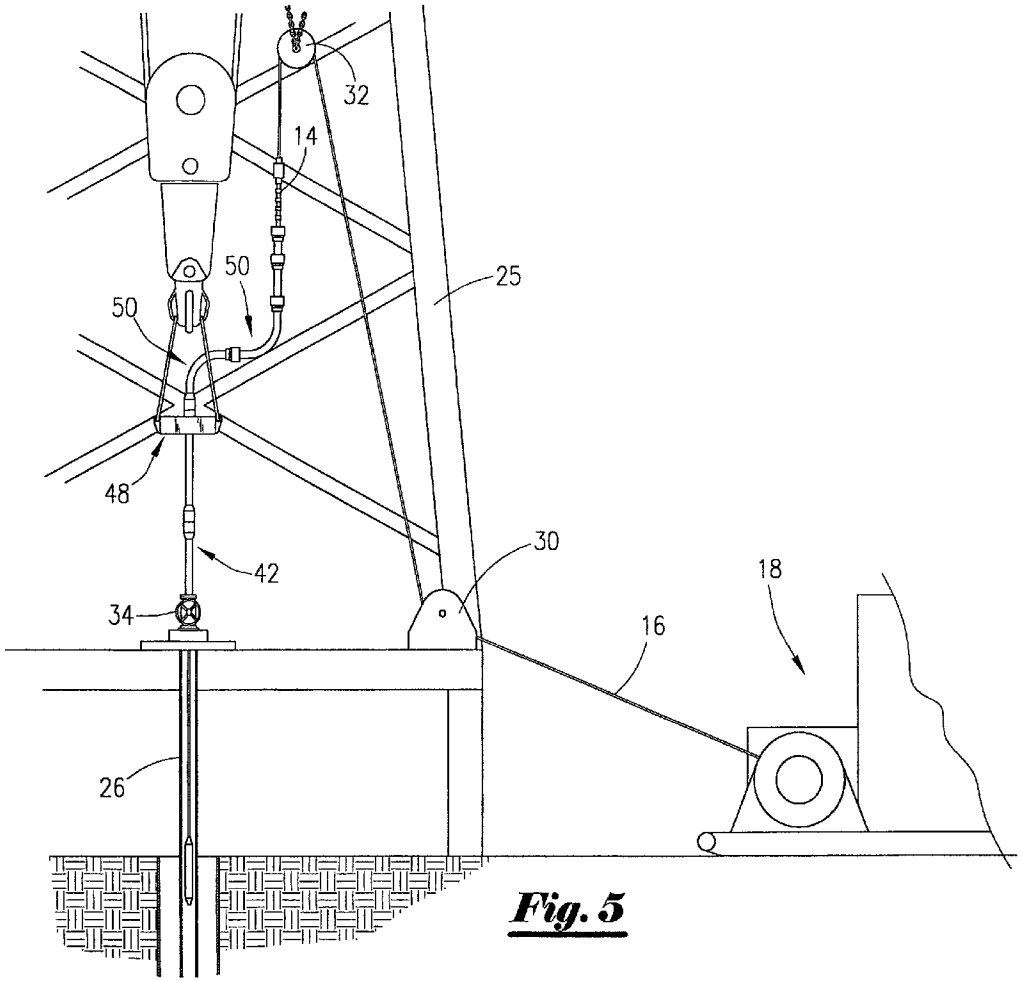
FIG. 5 is a vertical elevation view of a third embodiment of two 90-degree radial wire-line cable conveyers connected in tandem in a free point riser rig-up for use with elevators.

In some cases it may be advantageous to route the wire-line riser assembly high in the derrick with a free-point arrangement as seen in FIG. 5 without using the "Y" sub 44 shown in FIG. 4. In this case the riser assembly 42 is supported or lifted by the elevators 48 and the wire-line cable 16 is fed through on two sheaves, the temporary derrick sheave 32 and deck sheave 30. However, the traveling block from which the elevators 48 are suspended creates interference problems with the grease head if allowed to remain vertical along the centerline of the wellhead. Therefore, by utilizing a pair of 90-degree high-pressure wire-line conveyer assemblies, 50 the grease head can be offset to avoid the traveling block.

Figure 6:
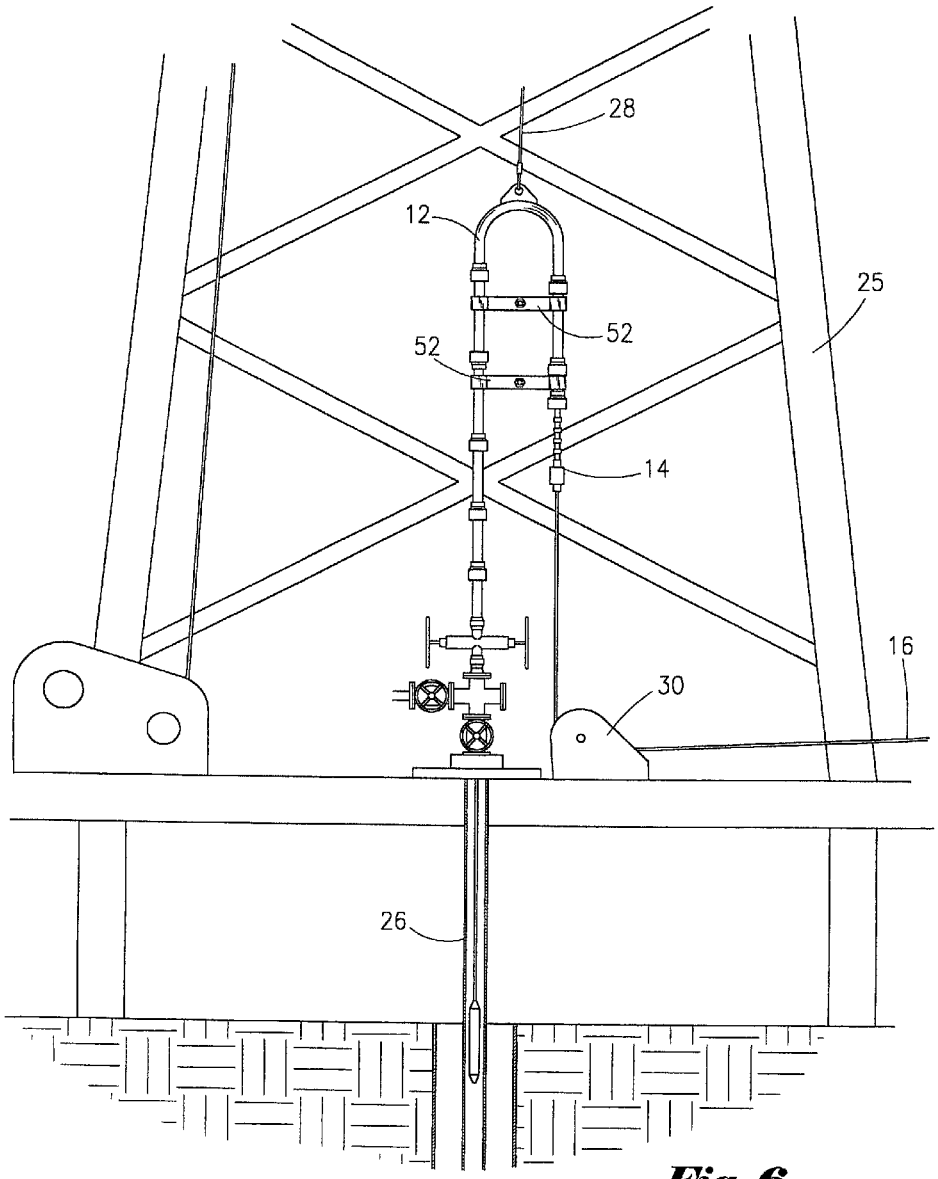
FIG. 6 is a vertical elevation view of a fourth embodiment of a radial wire-line cable conveyer with parallel riser member connector bracing.

In some cases the bent riser assembly, as previously described in FIG. 1, forming "U"shape of parallel riser members may need additional cross bracing between the parallel riser members as seen in FIG. 6 to insure unit integrity. This may be achieved with one or more pipe hanger clamps 52.

Figure 7:
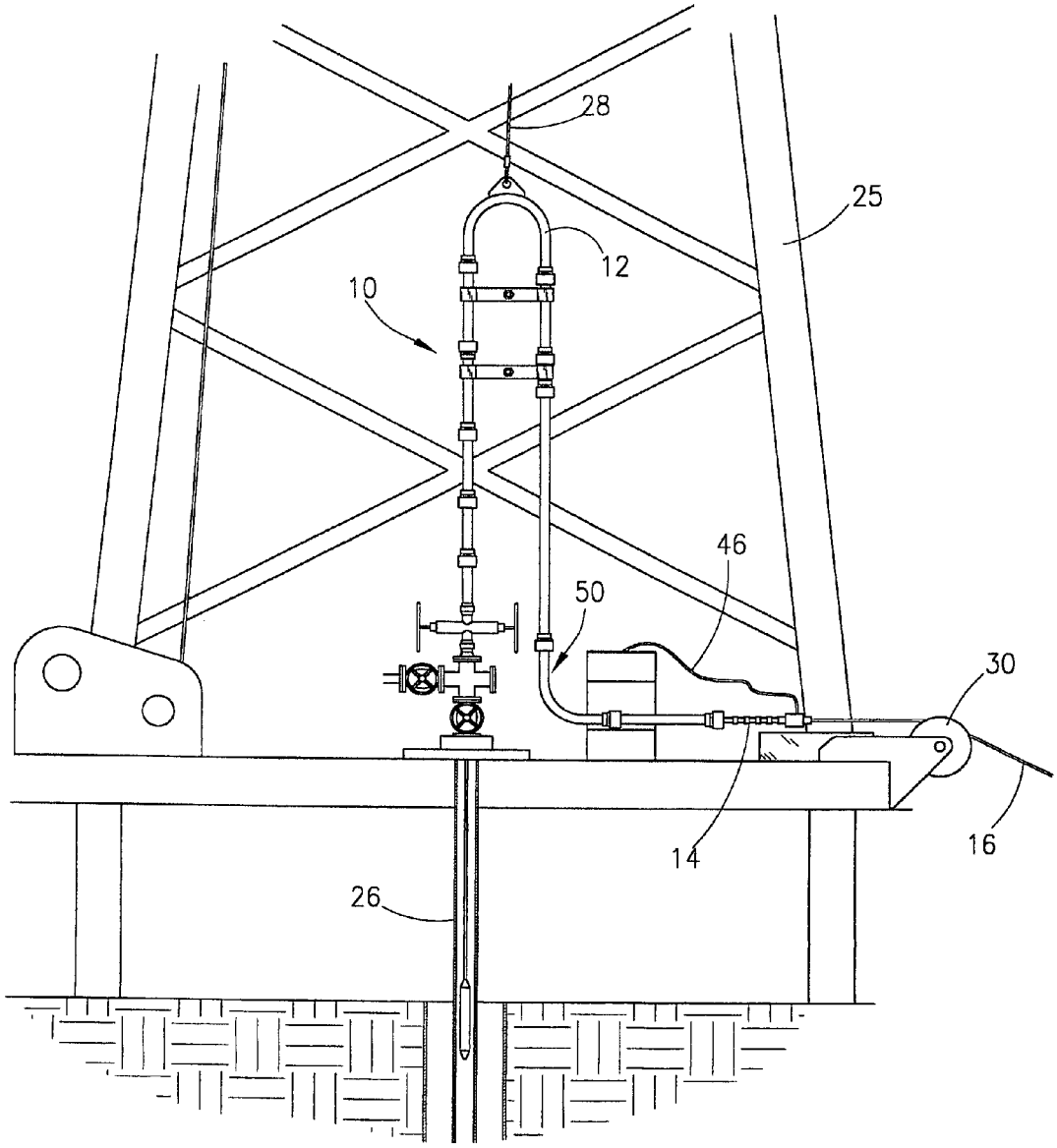
FIG. 7 is a vertical elevation view of a fifth embodiment utilizing multiple radial wire-line cable conveyers within a wire-line.

As illustrated in FIG. 7 the riser assembly previously illustrated in FIGS. 1 and 7 may also include additional conveyor assemblies 50 as necessary to route the wire-line to the wire-line cable reel by the shortest and most direct route, thereby reducing stress on the wire-line cable.

Figure 8:
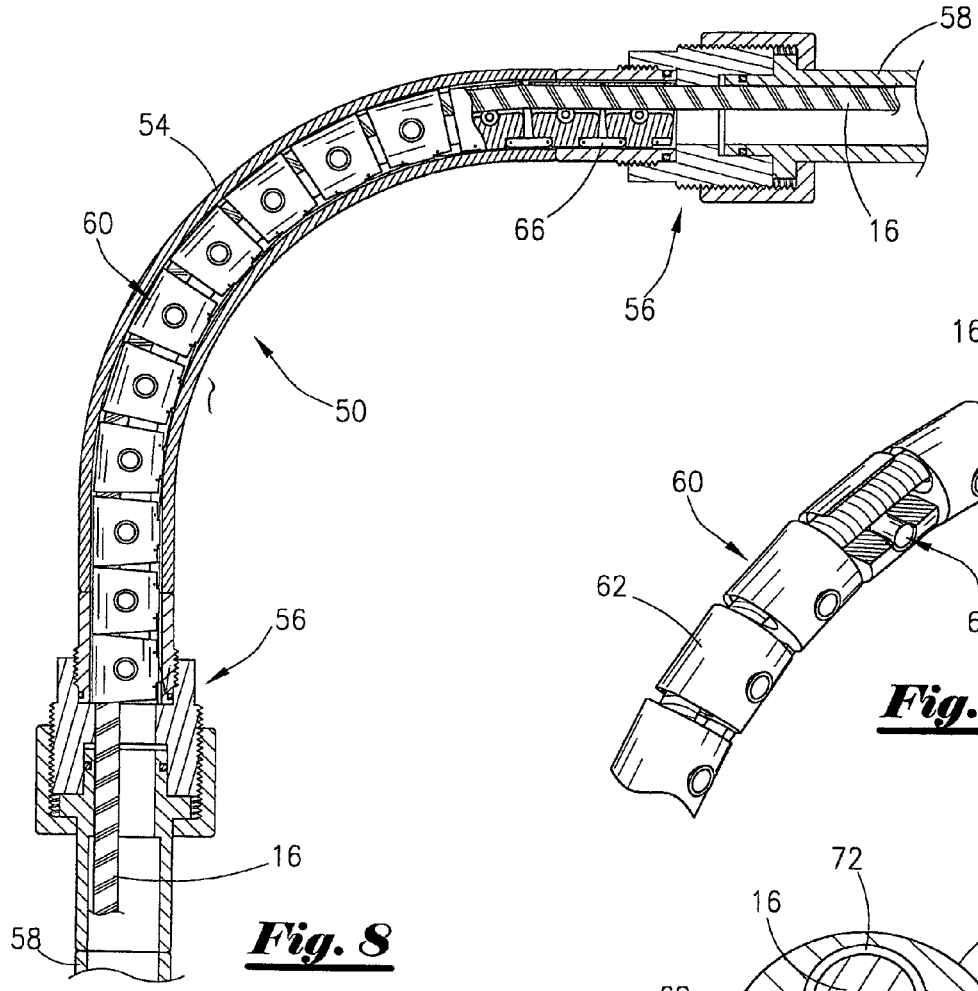
FIG. 8 is a cross-section view of the radial wire-line cable conveyer capable of being pressurized.
Figure 9:
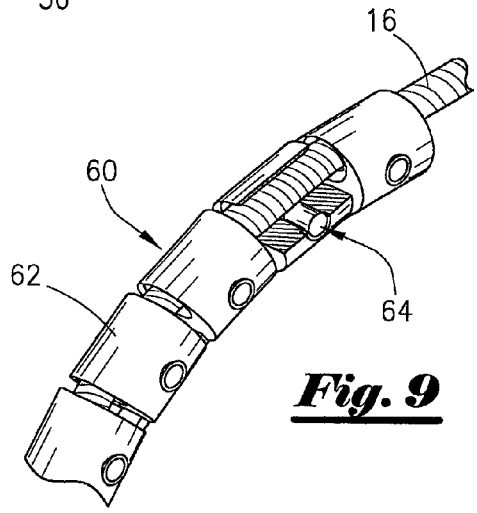
FIG. 9 is a partial isometric view with cut-away view of the roller assembly.
Figure 10:
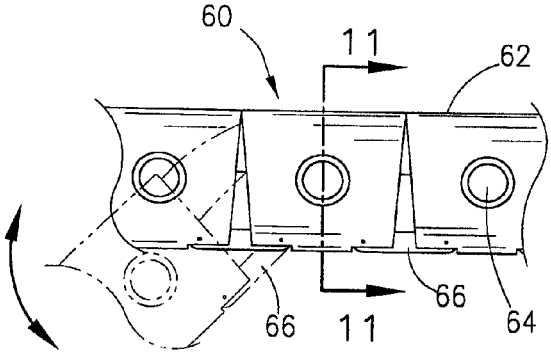
FIG. 10 is a side view of the roller assemblies connected in tandem showing pivotal movement in phantom.
Figure 11:
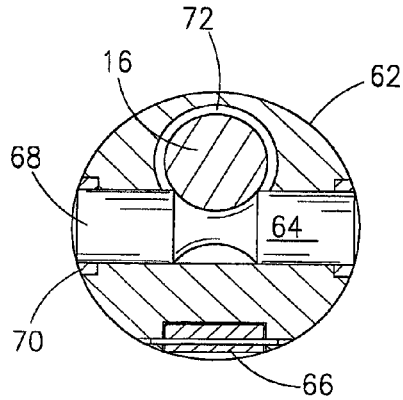
FIG. 11 is a cross-section view of the roller assembly taken along sight line 11-11 seen in FIG. 10.
Figure 12:
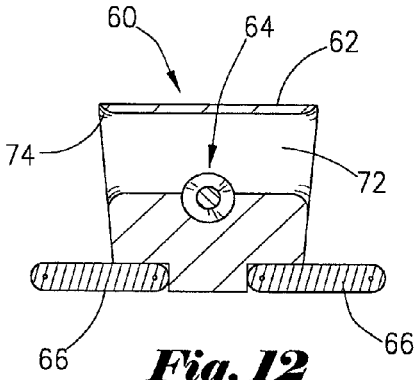
FIG. 12 is a side elevation cross-section view of the roller assembly.

Looking now at FIG. 8 we see that the high pressure wire-line conveyer assembly 12 includes the radial tubular member 54 which may be bent to any arc between 0 and 180 degrees, a removable coupling assembly 56 located at each end configured for adaptation to any pipe or tube connection composing the riser assembly 10. The coupling assemblies 56 may also be threadably adapted to box and pin joint connections, flange fittings or adaptively welded to pipe or tubing 58 as shown in FIG. 8. In any case, at least one of the coupling assemblies 56 must be removable from the tubular member 54 to allow for insertion and removal of the roller assembly 60. The roller assembly 60 as shown in more detail in FIG. 9 includes a plurality of cylinders 62 linked together in tandem. Each cylinder 62 has an aperture for passing the wire-line cable 16 supported upon a roller assembly 64. As seen in FIG. 10, each of the cylinders 62 is linked by a pin and connector 66, seen in cross section in FIG. 8 and in phantom here, allows the cylinders to articulate relative to each other thereby conforming to the radius of the tubular member 54. The wire-line cable 16 is supported by a grooved roller 68 supported at each end by sealed bearings 70 as shown in FIG. 11. This arrangement insures that the wire-line cable 16 passing through the longitudinal aperture 72 remains in contact with the roller 64, thereby reducing binding and cut wire-line cables usually found when using sheaves. Each end of the cylinder 62 is tapered and flared to maximize free running of the wire-line cable 16 through the cylinder assembly 60 as seen in detail in FIG. 12.

Figure 13:
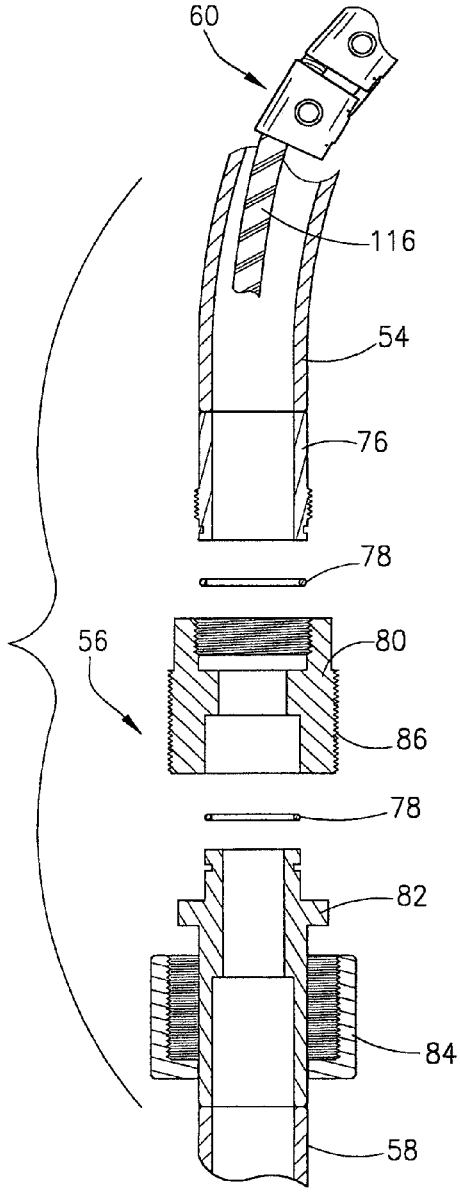
FIG. 13 is an exploded cross-section view of the coupling assembly.

Looking now at FIG. 13 the radial tube 54 housing the roller assembly 60 is attached to an adaptor member 76 having external threads and an O-ring seal 78. The threads 76 are cooperative with the internal threads of the body member 80 of the coupling assembly 56. A second adaptor member 82 is slidably connected to the body member 80 and sealed with a second O-ring 78' and fitted with a rotatable nut 84 having internal threads cooperative with external threads 86 located on the body member 80. The second adaptor is then adaptively attached to other tubular members of the riser assembly 10.

Figure 14:
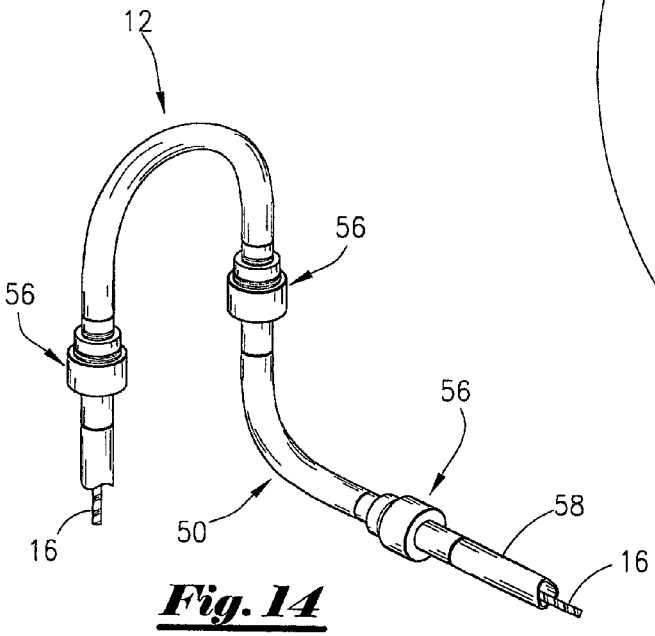
FIG. 14 is an isometric view of a 90-degree and 180-degree radial wire-line cable conveyer connected in tandem with ends in different planes.

It should be noted that although any arc with any radius desired may be used to convey the wire-line cable around such bends, it may be more practical to make up 90 or 180 degree assemblies and use combinations thereof for various applications which may include applications where each end of the assembly is in a different plane as seen in FIG. 14.

Figure 15:
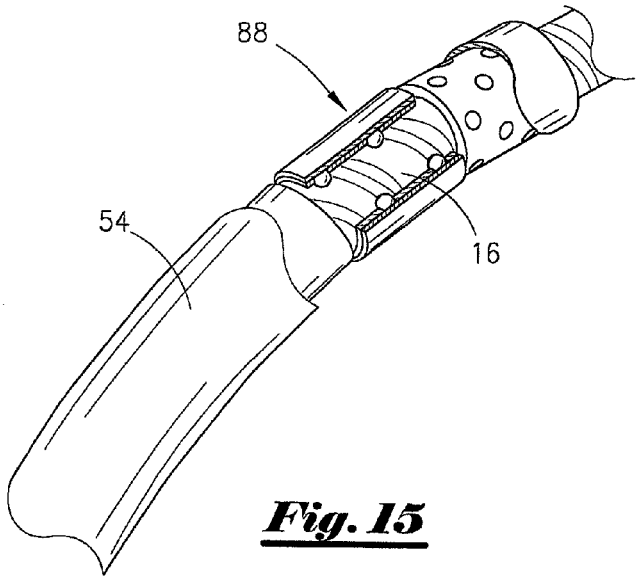
FIG. 15 is an isometric, cut-away view of a second embodiment of the wire-line cable carrier means.
Figure 17:
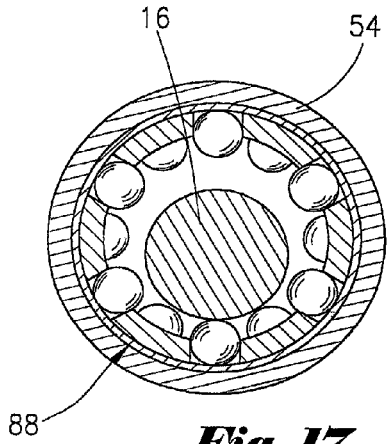
FIG. 17 is a cross-section end view of the second embodiment of the wire-line cable carrier means.
Figure 16:
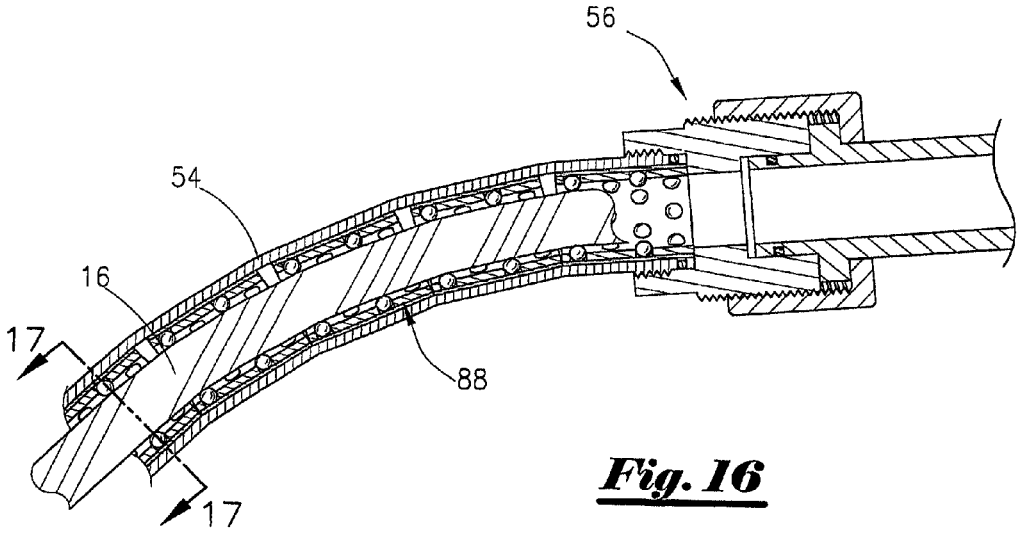
FIG. 16 is an isometric, cross-section view of the second embodiment of the wire-line cable carrier means.

The conveyance of a wire-line cable around a bend within a pressurized tubular member may be achieved by the alternative method illustrated in FIG. 15. As seen here, the wire-line cable 16 is threaded through a series of ball rollers assemblies 88. Each ball roller assembly 88 has a plurality of rolling balls that allows the wire-line cable 16 to pass freely through its longitudinal bore. The ball assemblies may be inserted in tandem into the bent housing 54 as seen in FIG. 16 and may carry wire-line cables sizes up to the maximum ball inner diameter as shown in FIG. 17.

Figure 18:
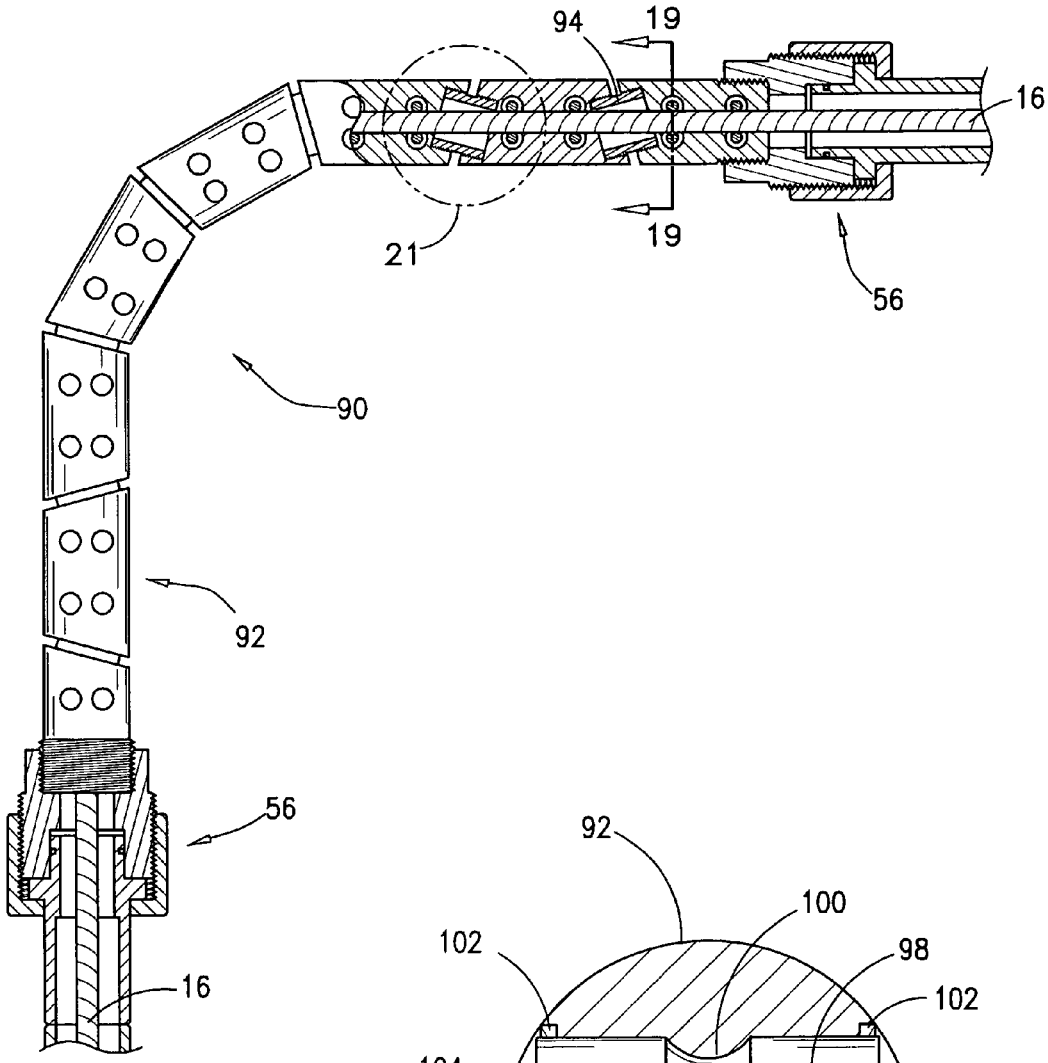
FIG. 18 is a partial cross-section view with cut-away views of a third embodiment of the roller conveyor assembly.
Figure 19:
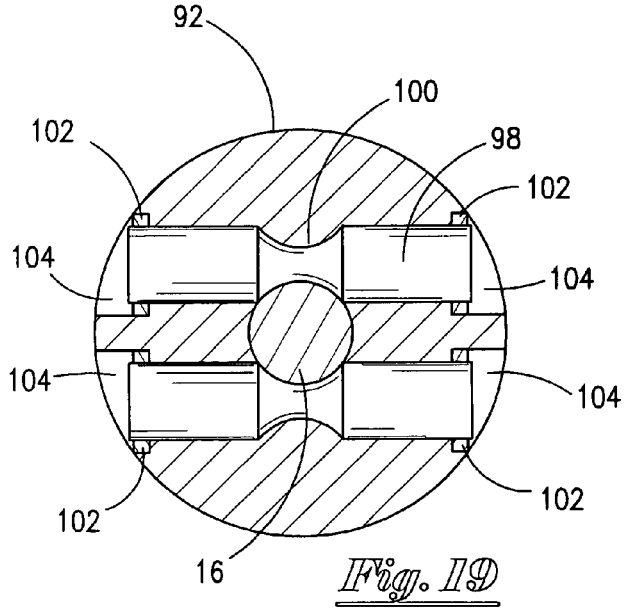
FIG. 19 is a cross-section view of one segment of the third embodiment taken along site lines 19-19 seen in FIG. 18.
Figure 20:
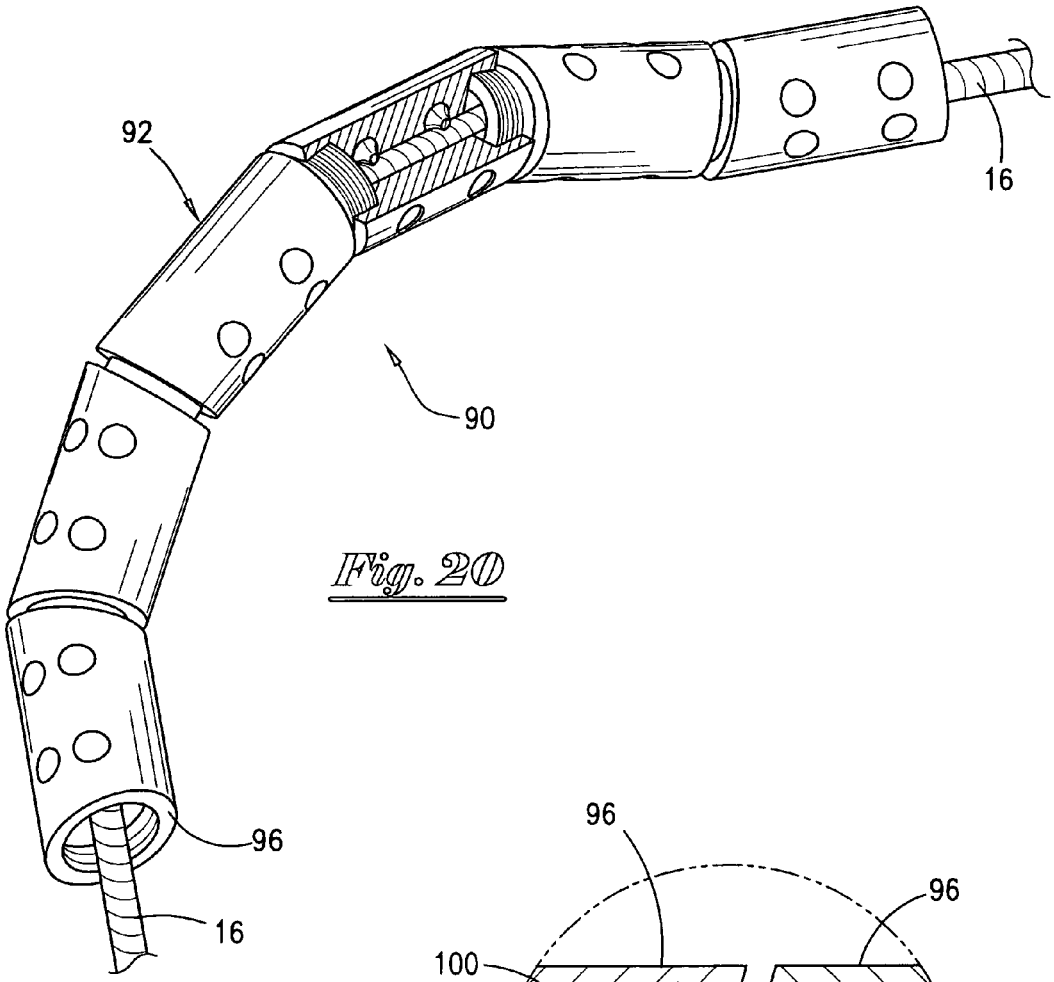
FIG. 20 is an isometric assembly view of a forth embodiment with a cut-away section of one roller conveyor segment.
Figure 21:
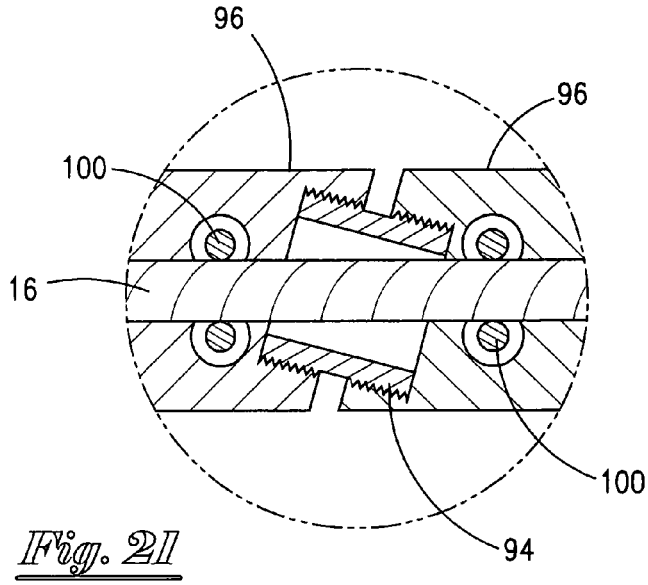
FIG. 21 is a partial cross-section of the roller conveyor segment shown in FIG. 20.

Looking now at FIG. 18, we see yet another embodiment of an articulatable wire-line roller conveyor assembly 90. In this assembly 90, the tubular segment assemblies 92 are joined by threaded pipe nipples 94, best seen in FIG. 21. Each tubular segment assembly 92 includes a mitered end face 96 at each end as seen in FIG. 20 to allow the segments to be rotated to make straight, radial or reverse curves in the general assembly 90. Each tubular segment assembly 92 is a tubular member having a straight central bore. Transverse hourglass configuration rollers 98 utilizing the necked portion 100 for guiding the wire-line 16 through the segments 92. The rollers 98 are installed at the center of each tubular segment assembly 92 or adjacent each mitered end face 96 as shown in FIGS. 18-20, and are supported by sealed bearings 102. The rollers 98 and bearings 102 may be installed above and/or below the central bore provided the neck portion 100 of the roller 98 intersects the central bore, in a transverse manner. Additional seals may be installed, as needed, in the bearing bores 104 after insertion of the rollers and bearings 98, 102 to insure the pressure integrity of the pressurized central bore.

Figure 22:
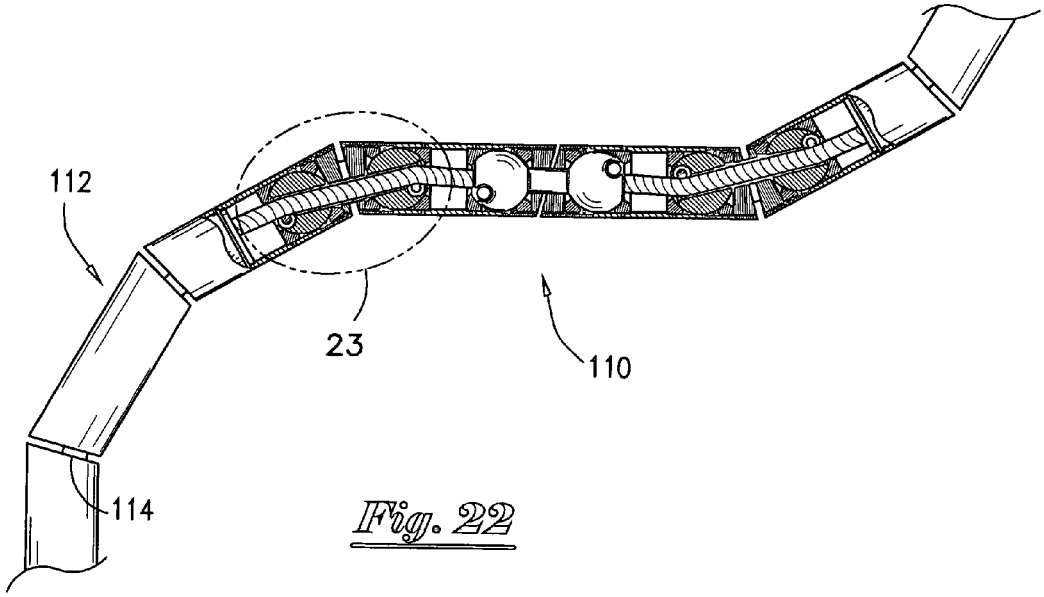
FIG. 22 is an isometric view of a fifth embodiment with cut-away views of a the roller conveyor segments.
Figure 23:
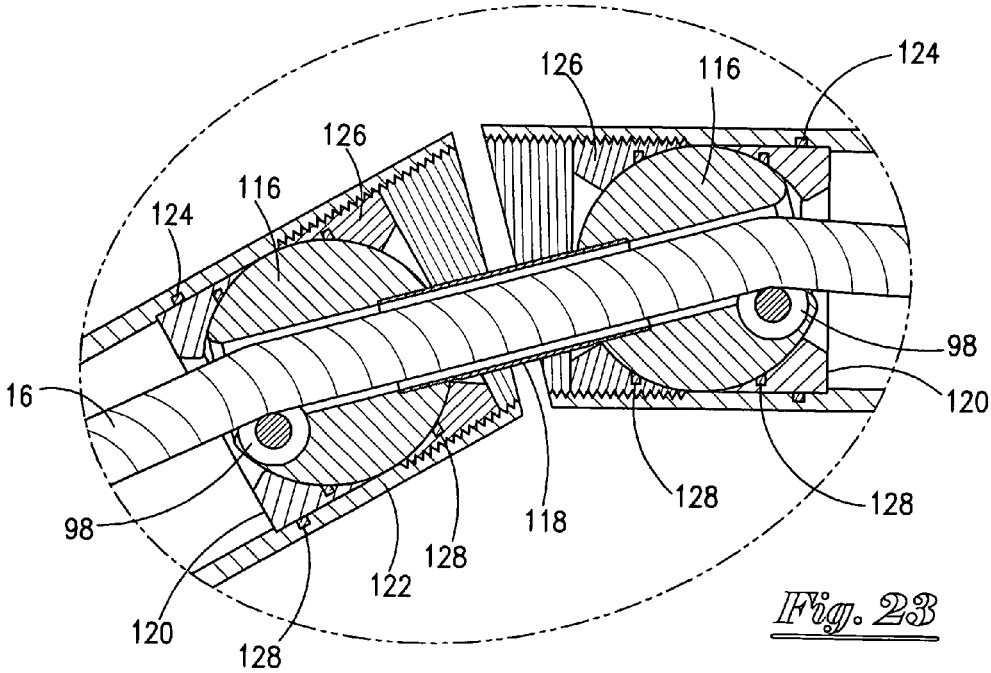
FIG. 23 is a cross-section view of adjoining segments of the roller conveyor shown in FIG. 22.

As seen in FIG. 22 we have still another embodiment of an articulatable wire-line cable roller conveyor assembly 110 wherein each of the segment assemblies 112 are elongated straight tubular segment assemblies and, as with all beveled segments disclosed herein, beveled or mitered faces may be between 0 and 60 degrees but the optimum is approximately 15 degrees. As shown in FIG. 23, the tubular segment assemblies 112 are connected to each other by a set of spherical 1 116 joined by a tubular coupling 118. A lower seat member 120 having a spherical cup therein is pressed into the tubular housing 122. With the spherical ball 116 in place within the lower cup/seat member 120 the upper cup/seat member 126 is threadably installed within the tubular segment, thereby securing the spherical ball 116 within the tubular segment housing 122. External seal rings 124 are provided between the lower seat cup members and tube housing 122 . Seals 128 are also provided between the ball and each of the cup seats 120, 126. In this configuration the tubular segment assemblies 112 are allowed to rotate about the balls 116 as necessary to articulate the segments and thus allow adjoining reverse or acute angle radius, as shown in FIG. 22. Each of the balls 116 have a central through bore and are fitted with at least one roller 98 having a neck portion 100 intersecting the central bore and support bearings 102 in the manner seen in FIG. 19. High-pressurized wire-line grease forced through the segments around the wire-line cable 16 is maintained within the segments and provides lubrication for the balls 116 and rollers 98.

It should be noted that a plurality of the tubular segment assemblies 92, 112, are coupled together and fitted with wire-line couplings 56 for connection within wire-line riser assemblies to form straight line paths, reverse curves or radius as needed to provide the shortest path possible between the wire-line cable reel and the wellhead and thereby further provide a high pressure, articulated wire-line cable guide conveyor for wire-lines.

Figure 24:
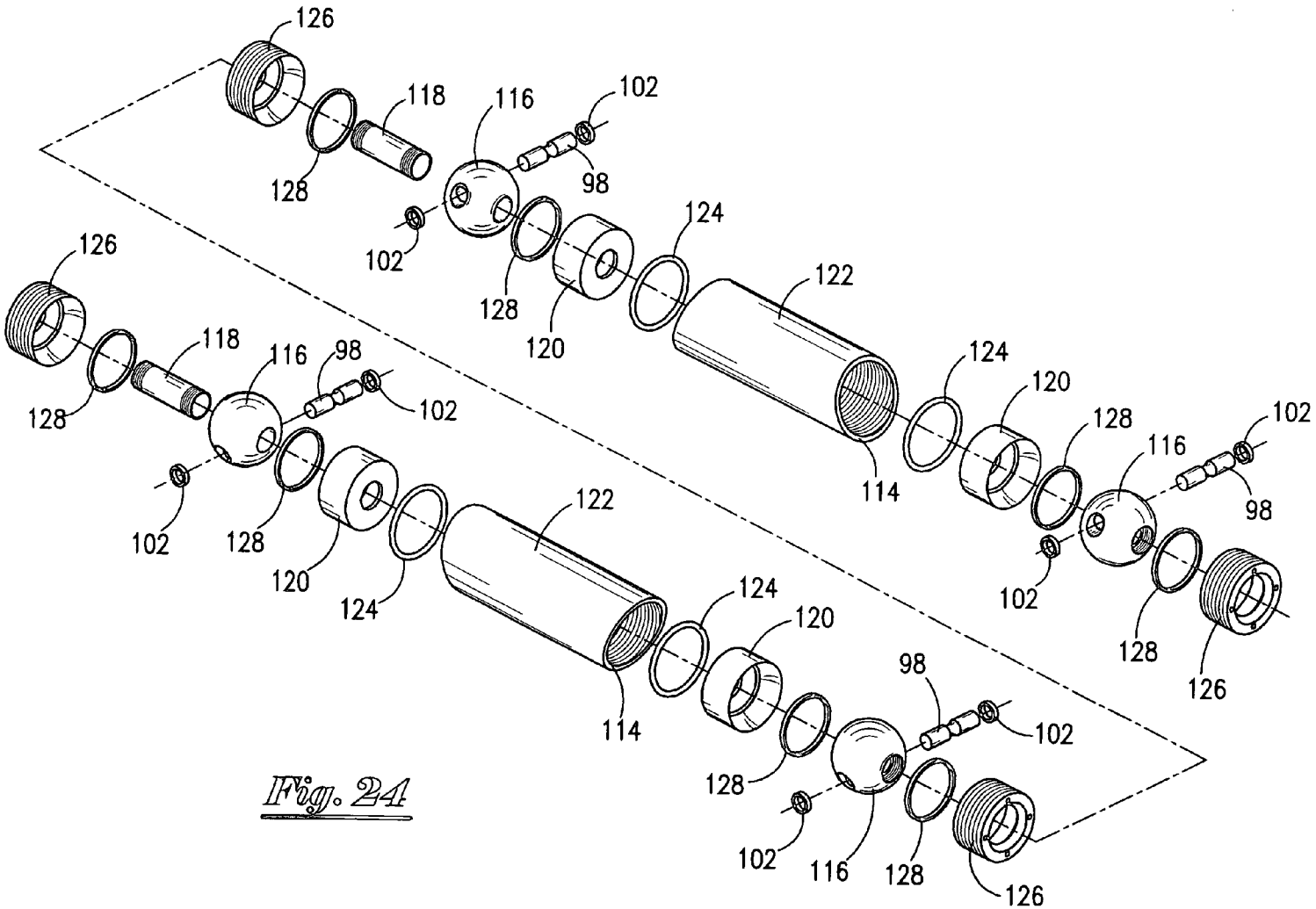
FIG. 24 is an exploded view of the elements comprising the adjoining segments shown in FIGS. 22 and 23.

A better understanding of the ball embodiment, shown in F*ig*. 22, may be had by viewing the exploded view FIG. 24.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An articulated wire-line guide assembly comprising:

a) a plurality of tubular segments each segment having mitered ends, and at least one transverse roller means for guiding and conveying a wire-line;

b) a nipple means for connecting the tubular segments one to another in a manner whereby the tubular segments may be rotated about their central longitudinal axis relative to each other; and c) a means for connecting a plurality of the tubular segments in a manner whereby the segments form a radial conduit element within a pressurized wire-line riser assembly.

2. The articulated wire-line guide assembly according to claim 1 wherein said nipple means is a threaded pipe nipple.

3. The articulated wire-line guide assembly according to claim 2 wherein at least one end of each of the tubular segments comprises an internal thread located perpendicular to the mitered ends for receiving the threaded pipe nipple.

4. The articulated wire-line guide assembly according to claim 2 wherein adjacent segments are coupled by a spherical element located in each of the tubular segments connected by a threaded pipe nipple.

5. The articulated wire-line guide assembly according to claim 4 wherein each of the tubular segments comprises at least one set of seats for retaining the spherical element.

6. The articulated wire-line guide assembly according to claim 5 wherein the set of seats comprises a lower seat having an internal spherical cup portion with internal and external seal members and an upper seat/cup having an internal spherical cup portion and internal seal member.

7. The articulated wire-line guide assembly according to claim 6 wherein the upper seat/cup threadably engages the interior of the tubular segment.

8. The articulated wire-line guide assembly according to claim 4 wherein each of the spherical elements comprises a central through bore.

9. The articulated wire-line guide assembly according to claim 8 wherein each of the spherical elements comprises a roller assembly transverse to and intersecting the through bore.

10. The articulated wire-line guide assembly according to claim 1 wherein each transverse roller comprises an hour glass configuration.

11. The articulated wire-line guide assembly according to claim 1 wherein at least one of the tubular segments comprises an external thread portion for connecting a wire-line riser-coupling member.

12. The articulated wire-line guide assembly according to claim 1 wherein each of the tubular segments comprise a plurality of opposing roller assemblies.

13. The articulated wire-line guide assembly according to claim 1 wherein adjacent tubular segments are rotated to form a radius.

14. The articulated wire-line guide assembly according to claim 1 wherein the adjacent tubular segments are rotated to form a straight-line path for the wire-line through at least two adjoining segments.

* * * * *